US005849389A

United States Patent [19]

Lunsford

[11] Patent Number: 5,849,389

[45] Date of Patent: Dec. 15, 1998

[54] CARPET COATING COMPOSITIONS

[75] Inventor: David J. Lunsford, Simpsonville, S.C.

[73] Assignee: National Starch and Chemical Investment Holding Corporation, Wilmington, Del.

[21] Appl. No.: 814,525

[22] Filed: Mar. 10, 1997

[51] Int. Cl.[6] ..... B32B 3/02

[52] U.S. Cl. ..... 428/95; 428/97

[58] Field of Search ..... 428/95, 97

[56] References Cited

U.S. PATENT DOCUMENTS

| | | | |
|---|---|---|---|
| 3,642,680 | 2/1972 | Jennings et al. | 260/29.6 |
| 3,716,504 | 2/1973 | Lindemann et al. | 260/8 |
| 3,950,198 | 4/1976 | Cannon et al. | 156/79 |
| 4,118,356 | 10/1978 | Devona et al. | 260/29.6 |
| 4,239,563 | 12/1980 | Iacoviello | 156/72 |
| 4,430,468 | 2/1984 | Schumacher | 524/109 |
| 4,434,258 | 2/1984 | Schumacher et al. | 524/13 |
| 4,503,185 | 3/1985 | Hausman et al. | 524/553 |
| 4,609,704 | 9/1986 | Hausman et al. | 524/710 |
| 4,619,964 | 10/1986 | Klelbania et al. | 524/460 |
| 4,634,730 | 1/1987 | Bogdany | 524/425 |
| 4,689,256 | 8/1987 | Slosberg et al. | 428/95 |
| 4,737,386 | 4/1988 | Wotier et al. | 427/389.9 |
| 4,740,394 | 4/1988 | Mudge | 427/389.9 |
| 4,808,459 | 2/1989 | Smith et al. | 428/95 |
| 5,024,840 | 6/1991 | Blakely et al. | 424/404 |
| 5,026,765 | 6/1991 | Katz et al. | 524/561 |
| 5,084,503 | 1/1992 | Iacoviello | 524/459 |

FOREIGN PATENT DOCUMENTS

| | | | |
|---|---|---|---|
| WO 90/00967 | 2/1990 | WIPO | B32B 3/02 |
| WO 93/23486 | 11/1993 | WIPO | C09D 133/06 |

OTHER PUBLICATIONS

Currie, Bill, "EVA Maintains Paint Properties, Lowers VOC", *Acrylated EVA: Formulating without Solvents,* Article Reprinted from Aug. 1993 issue of Modern Paint & Coatins.

*Primary Examiner*—Terrel Morris
*Attorney, Agent, or Firm*—John D. Thallemer

[57] ABSTRACT

The invention is directed to carpet coating compositions which utilize an emulsion binder which is prepared by emulsion polymerization of ethylene, a vinyl ester monomer having a Tg of between about 20° C. and about 45° C., and an essentially non-reactive monomer having a Tg of less than 10° C., and to carpet products prepared with the carpet coating compositions.

3 Claims, No Drawings

CARPET COATING COMPOSITIONS

FIELD OF THE INVENTION

The present invention relates to carpet coating compositions which contain an ethylene/vinyl ester-based emulsion binder and which exhibit improved adhesion to poly(vinyl chloride) plastisol substrates.

BACKGROUND OF THE INVENTION

Most conventional carpets comprise a primary backing with yarn tufts in the form of cut or uncut loops extending upwardly from the backing to form a pile surface. In the case of tufted carpets, the yarn is inserted into a primary backing by tufting needles and a pre-coat or binder is applied thereto. In the case of non-tufted or bonded pile carpets, the fibers are embedded and actually held in place by the binder composition.

In both cases, the carpet construction usually also includes a secondary backing bonded to the primary backing. The secondary backing provides extra padding to the carpet, absorbs noise, adds dimensional stability and often functions as a heat insulator. The secondary backing, typically either a woven fabric such as jute or a foam sheet, is laminated to the primary backing by a binder composition or by an adhesive layer applied to the tuft-lock coated primary backing. Similar techniques are used in the preparation of continuous (rolled) as well as carpet tiles. Generally these applications require a high degree of water resistance, a requirement which is usually met by the use of plastisol or addition of hot melt adhesive to the primary and/or secondary backings. The use of plastisol places a further requirement on the binder utilized in the primary coating that the binder comprise a composition onto which the plastisol will have good adhesion.

Thus, the physical properties of the binder are important to successful utilization as a carpet backing coating for the present invention. In this regard, there are a number of important requirements which must be met by such a coating. It must be capable of being applied to the carpet and dried using the processes and equipment conventionally employed in the carpet industry for latex, e.g. emulsion, coating. It must provide excellent adhesion to the pile fibers to secure them firmly to the backing, both in tufted and non-tufted constructions. The coating also must have low smoke density values and high flame retardant properties and must accept a high loading with fillers such as calcium carbonate, clay, aluminum trihydrate, barite and feldspar. Furthermore, the coating must maintain sufficient softness and flexibility, even with high filler loading or at low temperature, to enable the carpet, if prepared in continuous form, to be easily rolled and unrolled during installation. The softness and flexibility properties then will vary depending on the style of carpet but, in all cases, it is important that the carpet tile will lie flat and not exhibit a tendency to curl or dome.

It would be desirable to provide a coating composition for use in the manufacture of carpets and carpet tiles, wherein the coating composition exhibits superior balance of adhesion to poly(vinyl chloride) (hereinafter PVC) plastisol, low smoke generation, high flame retardance and dry and wet tuft bind strength. Further, the coating compositions must be able to accept and permanently adhere to a secondary backing such as PVC plastisol, hot melt adhesive, woven fabric, a foam or solid film or another backing composition.

SUMMARY OF THE INVENTION

The present invention is directed to carpet coating compositions which comprise an emulsion binder which contains an interpolymer prepared by emulsion polymerization of ethylene, a vinyl ester monomer which is copolymerizable with ethylene and which has a glass transition temperature (Tg) of between about 20° C. and 45° C. (referred to hereinafter as the high Tg vinyl ester monomer, or the HTVE monomer, which terms may be used interchangeably herein), and from about 1 pphm (parts by weight per hundred parts by weight of monomer used to prepare the interpolymer) to 10 pphm, of an essentially non-reactive monomer having a Tg of less than 10° C. (hereinafter the ENR monomer). The composition also may comprise an ingredient selected from the group consisting of a filler, a thickener, a defoamer, a frothing agent, and a dispersant, in amounts effective to perform their respective intended function. The invention also is directed to articles of manufacture, namely carpet products, which have applied thereto an amount of the coating composition effective to provide sufficient tuft-bind and improved adhesion to PVC plastisol substrates.

DETAILED DESCRIPTION OF THE INVENTION

The coating composition of the invention comprises an emulsion binder which comprises a high Tg vinyl ester-based interpolymer which is prepared by emulsion polymerization of from about 10 pphm to about 30 pphm of ethylene, from about 60 pphm to about 90 pphm of a HTVE monomer, from about I pphm to 10 pphm of an ENR monomer; and up to 5 pphm of optional comonomers, provided that the maximum amount of optional comonomer used must be effective to maintain the sufficient tuft-bind properties and adhesion to PVC plastisol of the coating compositions which contain the emulsion binders.

We now have found that emulsion polymers prepared from ethylene, a HTVE monomer and the ENR monomer provide superior binders for use in carpet backings, particularly for use in carpet backed with PVC plastisol. The emulsion binders may be formulated to prepare primary carpet coating compositions which contain 20 to 70 percent by weight of the emulsion binder and 80 to 30 percent by weight of filler, based on the total weight of the carpet coating composition.

The coating compositions of the present invention advantageously are utilized in the production of conventional tufted carpet, non-tufted carpet and needle-punched carpet and are dried using equipment which is readily available in most carpet mills. Thus, the coatings are useful in the production of pile carpets comprising a primary backing with pile yarns extending from the primary backing to form pile tufts; as well as non-tufted carpets wherein the fibers are embedded into a binder composition which has been coated onto a woven or non-woven substrate. In addition, the tuft-lock adhesive coating can be loaded to a high degree with a filler, such as calcium carbonate, clay and aluminum trihydrate, which enhances the flame retardancy and low smoke properties of the carpet without adversely affecting the adhesive properties of the coating. For example, the coating may comprise from about 20 to 70 percent by weight of the emulsion binder composition and from about 80 to 30 percent by weight of aluminum trihydrate filler.

The present invention also provides a method of preparing a pile or tufted carpet which includes the steps of;

a) tufting or needling the yarn into a woven or non-woven backing;

b) applying the carpet coating of the present invention to the rear of the backing such that the yarn is embedded in the carpet coating; and c) drying the resultant carpet construction.

In producing such tufted carpets it is also desirable to apply a secondary backing to the primary backing either before or after drying of the carpet coating, depending upon the type of backing employed.

Non-tufted carpets also may be prepared utilizing the carpet coating compositions of the invention by a method which comprises the steps of:

a) coating the composition of the present invention onto a substrate;

b) embedding the carpet fibers in the substrate; and c) drying the resultant carpet construction.

These non-tufted carpets also may be advantageously prepared utilizing a secondary backing to provide additional dimensional stability.

The HTVE monomers utilized to prepare the emulsion binders herein are the esters of alkanoic acids, the acid having from one to about 13 carbon atoms, which esters have a Tg of between about 20° C. and 45° C. Vinyl acetate is the preferred monomer because of its ready availability and low cost. The HTVE is used in amounts of from about 60 pphm to about 90 pphm, preferably 70 pphm to 85 pphm.

The ethylene component generally is added at levels of from about 10 pphm to about 30 pphm, preferably from about 10 pphm to about 20 pphm.

An ENR monomer is used in preparation of the emulsion binders. The ENR monomer will have a Tg of less than 10° C., preferably less than 5° C., and most preferably less than 0° C. The ENR monomer is essentially free of reactive moieties such as carboxyl, hydroxyl, epoxy and acrylamide moieties. By essentially free of reactive moieties, it is meant that the ENR monomer itself does not contain functional groups, other than the polymerizable carbon-carbon double bond, at levels which would reduce significantly either the tuft-bind or adhesion to PVC plastisol of the carpet coating composition which utilized interpolymers prepared from such ENR monomers, when compared to carpet coating compositions which utilized interpolymers prepared from similar monomers which did not contain such reactive moieties. Preferably the ENR monomer itself is free of such reactive moieties.

Exemplary ENR monomers include $C_1$–$C_{10}$ alkyl esters of acrylic acid, $C_2$–$C_{10}$ alkyl esters of α,β-ethylenically unsaturated $C_4$–$C_6$ monocarboxylic acids, $C_4$–$C_{10}$ dialkyl esters of α,β-ethylenically unsaturated $C_4$–$C_8$ dicarboxylic acids and vinyl esters of alkanoic acids, which vinyl esters have a Tg of less than 10° C. (hereinafter referred to as the low Tg vinyl ester monomer, or the LTVE monomer, which terms are used interchangeably herein). Exemplary LTVE monomers include vinyl isobutyrate, vinyl-2-ethylhexanoate, vinyl propionate, vinyl isooctanoate and vinyl versatate. Preferably, the ENR monomer is selected from the group consisting of $C_2$–$C_{10}$ alkyl esters of acrylic and methacrylic acid and $C_4$–$C_8$ dialkyl esters of maleic, itaconic and fumaric acids. Preferably, at least one $C_2$–$C_8$ alkyl ester of acrylic acid is utilized. Particularly preferred ENR monomers include ethyl acrylate, butyl acrylate, 2-ethyl hexyl acrylate, decyl acrylate, dibutyl maleate and dioctyl maleate.

Comonomers having a Tg of 50° C. or greater may be employed herein, although they are not preferred. Representative "high" Tg comonomers include methyl methacrylate, styrene, dimethyl maleate, t-butyl methacrylate, t-butyl isobornyl acrylate, phenyl methacrylate, acrylonitrile and vinyl esters of alkanoic acids having Tg of greater than 50° C. Such vinyl esters include vinyl nonate and vinyl pivalate. If used, these hard monomers generally are used at levels of less than 5 pphm, preferably less than 2.5 pphm. Preferably, the emulsion binders are prepared without the use of such hard monomers.

It may also be desired to incorporate in the interpolymer minor amounts of one or more functional comonomers. Suitable copolymerizable comonomers include, for example, acrylic and methacrylic acid or the half esters of maleic acid such as monoethyl, monobutyl or monooctyl maleate, acrylamide, tertiary octylacrylamide, N-methylol (meth)acrylamide, N-vinylpyrrolidinone, diallyl adipate, triallyl cyanurate, butanediol diacrylate, allyl methacrylate, etc., as well as $C_2$–$C_3$ hydroxyalkyl esters such as hydroxyethyl acrylate, hydroxy propyl acrylate and corresponding methacrylates. The latter comonomers generally are used at levels of less than 5 pphm, preferably less than 2.5 pphm, depending upon the nature of the specific comonomer. Preferably, the emulsion binders are prepared without the use of such monomers.

In addition, certain copolymerizable monomers which assist in the stability of the emulsion binder, e.g., vinyl sulfonic acid, are also useful herein as emulsion stabilizers. These optionally present monomers, if employed, are added in very low amounts of from 0.1 pphm to about 2 pphm.

Preferably, the interpolymer is the emulsion polymerization product of from about 10 pphm to about 30 pphm of ethylene monomer, from about 60 pphm to about 90 pphm of the HTVE monomer, from about 1 pphm to 10 pphm of the ENR monomer and less than 5 pphm of comonomers having a Tg of greater than 50 C. or comonomers comprising reactive moieties. More preferably, the interpolymer is prepared by emulsion polymerization of from about 10 pphm to about 20 pphm of ethylene, from about 70 pphm to about 85 pphm of vinyl acetate, from about 1 to about 7 pphm of the ENR monomer and less than 5 pphm of the comonomer. Even more preferably, less than 2.5 pphm of comonomer are used in preparing the interpolymer.

Methods for preparing ethylene/vinyl acetate copolymer emulsions are well known in the art and any of the customary procedures, together with the incorporation of ethylene pressure, can be used such as those emulsion polymerization techniques described in such chemistry texts as POLYMER SYNTHESIS, Vol. I and II, by Stanley R. Sandier and Wolf Karo, Academis Press, New York and London (1974), and PREPARATIVE METHODS OF POLYMER CHEMISTRY, second edition, by Wayne R. Sorenson and Tod W. Campbell, Interscience Publishers (John Wiley & Sons), New York (1968) and in U.S. Pat. No. 5,026,765.

A preferred method for preparing the ethylene/vinyl acetate-based emulsion of this invention having a solids content of from about 40 to about 75 weight percent involves the initial preparation of a seed emulsion. A premix comprising emulsifying agents and hydroxyethyl cellulose initially is charged to a polymerization reactor, agitated and purged with nitrogen twice and then with ethylene. A required amount of vinyl acetate monomer is charged to the reactor for seed formation. The reactor then is pressurized with the requisite ethylene pressure to provide the EVA copolymer having the desired ethylene content. The reaction is redox polymerized. The pressurized ethylene source can be shut off from the reactor so that the ethylene pressure decays as it is polymerized, or it can be kept open to maintain the ethylene pressure throughout the reaction, i.e., make-up ethylene. At about 40° C., the pressure is equilibrated to a desired ethylene pressure.

After seed formation, the redox components and monomer slow-add are added over a period of time. At the end of reaction, the material (having free VA monomer of approximately 2–3%), is transferred to a stripper. Reducing/oxidizing agents then are added until the free monomer content is reduced to less than 1%, preferably less than 0.1%. The polymerization reaction medium is cooled and adjusted to a pH of about 4 to 6 to maintain a stable emulsion.

Suitable free radical polymerization catalysts are the catalysts known to promote emulsion polymerization and include water-soluble oxidizing agents, such as, organic peroxides (e.g., t-butyl hydroperoxide, cumene hydroperoxide, etc.), inorganic oxidizing agents (e.g., hydrogen peroxide, potassium persulfate, sodium persulfate, ammonium persulfate, etc.) and those catalysts that are activated in the water phase by a water-soluble reducing agent. Such catalysts are employed in a catalytic amount sufficient to cause polymerization. As a general rule, a catalytic amount ranges from about 0.1 to 5 pphm.

The emulsifying agents are those generally used in emulsion polymerization. The emulsifiers can be anionic, cationic, surface-active compounds or mixtures thereof.

Suitable nonionic emulsifiers include polyoxyethylene condensates. Exemplary polyoxyethylene condensates which can be used include polyoxyethylene aliphatic ethers, such as polyoxyethylene lauryl ether and polyoxyethylene oleyl ether; polyoxyethylene alkaryl ethers, such as polyoxyethylene nonylphenol ether and polyoxyethylene octylphenol ether; polyoxyethylene esters of higher fatty acids, such as polyoxyethylene laurate and polyoxyethylene oleate, as well as condensates of ethylene oxide with resin acids and tall oil acids; polyoxyethylene amide and amine condensates such as N-polyoxyethylene lauramide, and N-lauryl-N-polyoxyethylene amine and the like; and polyoxyethylene thio-ethers such as polyoxyethylene n-dodecyl thio-ether.

Nonionic emulsifying agents which can be used also include a series of surface active agents available from BASF under the PLURONIC and TETRONIC trade names. PLURONIC® emulsifiers are ethylene oxide (EO)/Propylene oxide (PO)/ethylene oxide block copolymers which are prepared by the controlled addition of PO to the two hydroxyl groups of propylene glycol. EO is then added to sandwich this hydrophobe between two hydrophilic groups, controlled by length to constitute from 10% to 80% (w/w) of the final molecule. PLURONIC® R emulsifiers are PO/EO/PO block copolymers prepared by adding EO to ethylene glycol to provide a hydrophile of designated molecular weight. PO is then added to obtain hydrophobic blocks on the outside of the molecule. TETRONIC® emulsifiers are tetra-functional block copolymers derived from the sequential addition of PO and EO to ethylene-diamine. TETRONIC® R emulsifiers are produced by the sequential addition of EO and PO to ethylene-diamine. In addition, a series of ethylene oxide adducts of acetyleneic glycols, sold commercially by Air Products under the Surfynol® trade name, are suitable as nonionic emulsifiers.

Representative anionic emulsifiers include the alkyl aryl sulfonates, alkali metal alkyl sulfates, the sulfonated alkyl esters, and fatty acid soaps. Specific examples include sodium dodecylbenzene sulfonate, sodium butylnaphthalene sulfonate, sodium lauryl sulfate, disodium dodecyl diphenyl ether disulfonate, N-octadecyl sulfosuccinate and dioctyl sodiumsulfosuccinate. The emulsifiers are employed in amounts effective to achieve adequate emulsification of the polymer in the aqueous phase and to provide desired particle size and particle size distribution. Other ingredients known in the art to be useful for various specific purposes in emulsion polymerization, such as, acids, salts, chain transfer agents, and chelating agents, also may be employed in the preparation of the polymer. For example, if the polymerizable constituents include a monoethylenically unsaturated carboxylic acid monomer, polymerization under acidic conditions (pH 2 to 7, preferably 2 to 5) is preferred. In such instances the aqueous medium can include those known weak acids and their salts that are commonly used to provide a buffered system at the desired pH range.

Various protective colloids may also be used in place of or in addition to the emulsifiers described above. Suitable colloids include casein, hydroxyethyl starch, carboxyxethyl cellulose, gum arabic, and the like, as known in the art of synthetic emulsion polymer technology. In general, these colloids are used at levels of 0.05 to 4% by weight based on the total emulsion. Poly(vinyl alcohol) PVA-based protective colloids generally are not preferred for use in preparing the emulsion binders, although low levels may be tolerated. Preferably, the emulsion binders are prepared in the essential absence of PVA colloids and more preferably are prepared in the absence of PVA colloids.

The manner of combining the polymerization ingredients can be by various known monomer feed methods, such as, continuous monomer addition, incremental monomer addition, or addition in a single charge of the entire amounts of monomers. The entire amount of the aqueous medium with polymerization additives can be present in the polymerization vessel before introduction of the monomers, or alternatively, the aqueous medium, or a portion of it, can be added continuously or incrementally during the course of the polymerization.

Following polymerization, the solids content of the resulting aqueous heterogeneous polymer emulsion binder can be adjusted to the level desired by the addition of water or by the removal of water by distillation. Generally, the desired level of polymeric solids content is from about 40 weight percent to about 75 weight percent based on the total weight of the emulsion, more preferably from about 50 weight percent to about 70 weight percent.

If desired, conventional additives may be incorporated into the carpet binders of our invention in order to modify the properties thereof. Among these additives may be included fillers, thickeners, catalysts, dispersants, colorants, biocides, anti-foaming agents, etc.

In particular, the ability to load the coating with high amounts of fillers such as clay, calcium carbonate, aluminum trihydrate, barium, feldspar, etc., permits an increase in the superior flame retardancy and low smoke properties the copolymer already has. Preferred coating compositions in accordance with the present invention are loaded with filler to yield a composition comprising from about 20 to about 70 weight percent emulsion binder, and from about 80 to about 30 weight percent filler, based on total weight of the composition, depending in part on the type and form of the carpet being constructed.

In preparing a tufted carpet, the yarn is tufted or needled into a primary backing which is generally non-woven polypropylene, polyethylene or polyester or woven jute or polypropylene. If a secondary backing is used, it is generally formed of woven or non-woven materials similar to those used as the primary backing and applied directly to the wet pre-coated primary backing prior to the drying step or applied with a separator adhesive to the dried pre-coated primary backing. Such a secondary backing provides dimensional stability to the carpet. The secondary backing also may be in the form of a foam polymer or copolymer. Suitable foam compositions include urethane polymers, polymers and copolymers of ethylene, propylene, isobutylene and vinyl chloride. When a foam secondary backing is used, it may be prefoamed and then laminated onto the primary backing, or the composition may contain a thermally activatable blowing agent and may be foamed immediately prior to lamination or after lamination. Additionally, the secondary backing may exhibit thermoplastic adhesive properties of its own, and the secondary backing can be preheated prior to lamination to render the surface thereof adhesive. Alternatively, the secondary backing may comprise a hot melt, one or more or fused PVC plastisol layer(s) or bitumen, often in conjunction with fiberglass scrim or other scrim known to provide dimensional stability. It is also contemplated that the coating composition disclosed herein for use as the primary backing may be used as the secondary backing.

In forming a non-tufted carpet, the carpet coating is generally thickened to a viscosity of about 25,000 to 75,000 cps and applied to a scrim surface. The fibers then are directly embedded into the wet coating using conventional techniques and then dried. Again, a secondary coating similar to that described above is desirably employed.

The coating is easier to apply to the carpet than hot melt thermoplastic adhesives which require expensive and complex machines and processes to apply the coating, and the coating also penetrates the fibers of the carpet yarns to yield better adhesion, fiber bundle integrity and anti-fuzzing properties. Additionally, the coating exhibits particularly excellent tuft-bind properties. The term "tuft-bind" refers to the ability of the carpet coating to lock and secure the pile yarn tufts to the primary backing and is determined as set forth herein below. Additionally for the purposes herein, tuft-bind is also used to include the superior characteristics needed in non-tufted coatings wherein the adhesion of the fiber pile is achieved solely by the backing. Suitable tuft-bind properties can be achieved by applying an amount of coating ranging from about 10 ounces per square yard to about 40 ounces per square yard (dry basis), which results in a carpet having a tuft-bind value of at least 10 pounds force, and in many instances a tuft-bind value of 15 pounds force or greater.

The following test procedures were used to evaluate carpet coating compositions of the present invention.

CARPET TESTING PROTOCOLS

CARPET COATING FORMULATION

| | Pts by Wt |
|---|---|
| Interpolymer | 220 |
| Dispersant | 0.7 |
| Calcium Carbonate Filler | 330 |
| Acrylate Thickener | 2 |
| Starch | 15 |
| Water | 190 |

Total Compound Solids = 73–77%
Compound Viscosity 8,000–15,000 cps (#5 Spindle/77 F/20 rpm)

CARPET COATING PROCEDURE

Compounded samples were frothed in a lab foaming unit (Hobart mixer) to achieve foamed or frothed compounds with blow ratios of 1:1 to 3:1 (air to compound). The frothed compounds then were scrape-coated onto the back of tufted carpet. The tufted carpet had an uncoated weight 18 to 25 oz/yd$^2$. Once coated with the frothed compound, the carpet was dried at 130° C. for 8 minutes.

Add-on weights of dried precoat compound were in the range of 25 to 30 oz/yd$^2$. Precoated carpet samples were tested for dry and wet tuft bind values and for adhesion to PVC plastisol. Adhesion to PVC plastisol was measured by testing the ability of the precoated carpet to laminate to a preformed sheet of PVC plastisol.

TEST METHODS

TUFT BIND VALUES—DRY

This test measures the durability and wear resistance properties of the carpet by determining the amount of force (in lbs.) required to pull a loop or tuft through the backing. Testing is done by hooking an individual tuft or loop with a metal hook which is then secured in the upper clamp (or jaw) of an Instron. The carpet was attached to the bottom clamp of an Instron. The upper and lower clamps (or jaws) were separated at a constant rate of 12 inches/minute until the tuft was pulled through the primary backing. Test results are listed as an average of 10 to 12 tufts pulled from one coated carpet sample. Coated carpet samples were cooled at room temperature for at least 30 minutes prior to testing.

TUFT BIND VALUES—WET

Test is similar to the dry tuft bind method except that the samples were soaked in water at room temp (~25° C.) for 30 minutes prior to testing. After the 30 minute soak, samples were put through a set of nip rollers with a ⅜ inch gap to remove excess water from the samples prior to testing.

PVC ADHESION

This test measures the PVC adhesion properties of the carpet coating by testing the ability of the precoated carpet to laminate to a sheet of preformed PVC plastisol foam. The test was conducted by heating the carpet sample for 2 minutes and the PVC foam for 1 minute at a specified temperature. The PVC foam was placed in an oven after the carpet had been in the oven for 1 minute so that both samples exited the oven at the same time. The heated PVC foam was then placed in contact with the back of the carpet sample and put through a set of nip rollers with a ⅜ inch gap. This was done to simulate the heat lamination process used in the carpet industry. Finished carpet samples with PVC backing were rated to determine the degree to which the PVC foam adhered to the precoated carpet samples. When the foam adheres properly to the precoat layer the PVC foam will tear before the foam and carpet will separate. The rating system used is listed below.

Excellent=100% foam tear

Very Good=75 to 100% foam tear

Good=50 to 75% foam tear

Fair=25 to 50% foam tear

Poor=0 to 25% foam tear

Emulsion binders were prepared according to the procedures described herein above. Monomer composition of four binders prepared are set forth in Table 1.

TABLE 1

| BINDER | E | VA | BA | 2-EHA | B-CEA | Polymer Tg |
|---|---|---|---|---|---|---|
| B1 | 12 | 84 | — | 4 | — | −1.8 |
| B2 | 12 | 84 | 4 | — | — | 1.3 |
| B3 | 12 | 84 | 4 | — | 0.3 | −0.8 |
| B4 | 12 | 85 | — | — | — | −0.3 |

All values are pphm
E = ethylene
VA = vinyl acetate
BA = butyl acrylate
2-EHA = 2-ethyl hexylacrylate
B-CEA = p-carboxy ethylacrylate The binders were formulated into the carpet coating formulation set forth above and identified as coatings C1–C4, corresponding to binders B1–B4. Carpet samples were prepared and each coating evaluated for dry tuft bind, wet tuft bind and adhesion to PVC foam both at 280° F. and 260° F. Results are set forth in Table 2.

TABLE 2

| | C1 | C2 | C3 | C4 |
|---|---|---|---|---|
| Precoat Wt (oz/sq. yd.) | 27 | 28 | 27 | 26 |
| Dry Tuft-bind | 13.1 | 15.7 | 16.4 | 15.2 |
| Wet Tuft-bind | 3.5 | 3.3 | 3.2 | 4.4 |
| Adhesion to PVC foam | | | | |
| 280° F. | E | E | E | VG |
| 260° F. | E | E | VG | F |

As the data indicate, the use of the ENR monomer in preparation of the emulsion binder, even at low levels, significantly increases adhesion of the carpet coating to PVC substrates when compared to coatings prepared from binders which were not prepared with an ENR monomer, particularly at the lower processing temperatures, which are desirable for use in manufacture of carpet products. As can seen in Table 2, preferred embodiments of the invention exhibit excellent adhesion at 280° F. and 260° F., while the comparative coating exhibited very good adhesion at 280° F., but only fair adhesion at 260° F. Importantly and surprisingly, the adhesion to PVC was significantly improved without significantly decreasing the tuft bind properties of the coating compositions. This particularly is surprising, as one would expect that by incorporation of low levels of the ENR monomer, there would be little improvement of adhesion to PVC plastisol and that tuft bind properties would be affected adversely. Nevertheless, the coatings of the present invention and the carpet products manufactured therefrom exhibit the right balance of tuft bind and adhesion to PVC. The data also indicate why it is important to limit the amount of monomers containing reactive moieties, such as B-CEA. As is seen, inclusion of 0.3 pphm of B-CEA reduces adhesion to PVC plastisol at lower processing temperatures of 260° F., although no noticeable difference was observed at process temperatures of 280° F. As one desirable aspect of the present invention is that it affords better adhesion at lower process temperatures, it is preferred to avoid excess use of such monomers.

We claim:

1. In a carpet product comprising a coating composition which secures carpet fibers to a carpet backing or substrate, the improvement comprising a carpet coating composition which comprises:

(a) an interpolymer present in an amount effective to function as a binder in the carpet coating composition, said interpolymer prepared by emulsion polymerization of (i) about 60 pphm to about 90 pphm of a high Tg vinyl ester monomer selected from the group consisting of esters of alkanoic acids wherein the alkenyl group has 1 to 13 carbon atoms, and the Tg of a polymer prepared from the high Tg vinyl ester monomer has a Tg of about 20° C. to about 45° C.;

(ii) about 10 pphm to about 30 pphm of ethylene; and (iii) about 1 to about 10 pphm of a low Tg vinyl ester monomer which is free of reactive moieties except for the vinyl group, said low Tg vinyl ester monomer is selected from the group consisting of $C_1$–$C_{10}$ alkyl esters of acrylic acid, $C_2$–$C_{10}$ alkyl esters of α,β-ethylenically unsaturated $C_4$–$C_6$ monocarboxylic acids, and $C_4$–$C_{10}$ dialkyl esters of α,β-ethylenically unsaturated $C_4$–$C_8$ dicarboxylic acids, wherein a polymer prepared from the low Tg vinyl ester monomer has a Tg of less than 10° C.;

(b) water; and (c) an emulsifier present in amounts effective to disperse the interpolymer in the water, wherein the vinyl ester monomers.

2. The carpet product according to claim 1 wherein the interpolymer is prepared by emulsion polymerization of about 70 pphm to about 90 pphm of the high Tg vinyl ester monomer, about 10 pphm to about 20 pphm of ethylene, and about 1 pphm to about 7 pphm of the low Tg vinyl ester monomer.

3. The carpet product according to claim 1 wherein the high Tg vinyl ester monomer is vinyl acetate and the low Tg vinyl ester monomer is selected from the group consisting of vinyl isobutyrate, vinyl-2-ethyl-hexanoate, vinyl propionate, vinyl isooctanoate, vinyl versatate, ethyl acrylate, butyl acrylate, 2-ethyl hexyl acrylate, decyl acrylate, dibutyl maleate and dioctyl maleate.

* * * * *